US005118012A

United States Patent [19]

Miller et al.

[11] Patent Number: 5,118,012

[45] Date of Patent: Jun. 2, 1992

[54] RESEALABLE TUBE SUPPORTING CAP

[75] Inventors: Christopher J. Miller; Edward A. Dzwill, both of Clifton Park, N.Y.

[73] Assignee: General Electric Company, Waterford, N.Y.

[21] Appl. No.: 661,772

[22] Filed: Feb. 26, 1991

[51] Int. Cl.[5] ..... B65D 35/56

[52] U.S. Cl. ..... 222/105; 222/179.5; 222/184

[58] Field of Search ..... 222/105, 184, 173, 179.5

[56] References Cited

U.S. PATENT DOCUMENTS

| | | | |
|---|---|---|---|
| 1,575,231 | 3/1926 | Seltmann | 222/105 |
| 1,590,636 | 6/1926 | McManus et al. | 222/105 |
| 1,892,140 | 12/1932 | Fogler | 222/105 |
| 2,076,826 | 4/1937 | Reinsberg | 222/105 |
| 2,078,149 | 4/1937 | Lutz | 222/105 |
| 2,084,568 | 6/1937 | White | 222/105 |
| 2,363,474 | 11/1944 | Schlesinger | 222/184 |
| 2,591,455 | 4/1952 | Marshall | 222/105 |
| 3,008,610 | 11/1961 | Jamison | 222/173 |
| 3,308,998 | 3/1967 | Oppasser et al. | 222/539 |
| 3,817,426 | 6/1974 | Fooks | 222/105 |
| 3,866,803 | 2/1975 | Kipfmueller | 222/179.5 |
| 4,111,331 | 9/1978 | Summers | 220/319 |
| 4,723,671 | 2/1988 | Mears | 215/228 |

FOREIGN PATENT DOCUMENTS

| | | | |
|---|---|---|---|
| 1042850 | 11/1958 | Fed. Rep. of Germany | 222/105 |
| 21617237 | 6/1973 | Fed. Rep. of Germany | 222/105 |
| 344071 | 6/1986 | Fed. Rep. of Germany | 222/105 |
| 980099 | 5/1951 | France | 222/173 |
| 1059372 | 3/1954 | France | 222/179.5 |
| 1574032 | 7/1969 | France | 222/105 |
| 2309183 | 11/1976 | France | 222/184 |
| 2395681 | 2/1979 | France | 222/105 |
| 659553 | 10/1951 | United Kingdom | 222/179.5 |

*Primary Examiner*—Michael S. Huppert
*Assistant Examiner*—Anthoula Pomrening

[57] ABSTRACT

A resealable tube supporting cap, which is strong, translucent and lightweight for use on a tube with an extended dispensing nozzle. The cap is particularly useful for a tube that contains moisture-sensitive material and provides an air-tight seal to protect the tube contents from atmospheric moisture, as well as a stable support for upright display or storage of the tube.

7 Claims, 3 Drawing Sheets

RESEALABLE TUBE SUPPORTING CAP

FIELD OF THE INVENTION

The present invention relates to a cap for a tube with an extended dispensing nozzle for applying the contents of the tube which cap when tightened on to the tube after initial use provides an air-tight seal and which cap permits the tube to be conveniently stored in an upright position.

BACKGROUND OF THE INVENTION

Heretofore, there have been closures for tubes which will function to support the tube in an upright position. U.S. Pat. No. 1,575,231 to Seltman relates to a closure consisting of a disk-shaped body portion with a plurality of depending leg members.

U.S. Pat. No. 1,590,636 to McManus et al. relates to a closure with a flattened end portion, a circular body portion and a neck portion.

U.S. Pat. No. 1,892,140 to Fogler relates to a closure with means to fix the closure to a smooth polished surface for convenient display purposes before sale or convenient use after purchase.

U.S. Pat. No. 2,076,826 to Reinsberg and U.S. Pat. No. 2,084,568 to White relate to a closure with a continuous skirt portion which serves as a finger grip to unscrew from or apply to the tube the closure and provides a stable base to maintain the tube upright when not in use.

U.S. Pat. No. 2,078,149 to Lutz relates to a conical replacement cap for a toothpaste tube with an opening through which toothpaste may be dispensed without removal of the cap and a stand into which the conical cap fits and which holds the toothpaste upright when not in use.

U.S. Pat. No. 3,308,998 to Oppasser et al. relates to a reversible closure which for storage positions a dispensing spout inwardly and for dispensing positions the dispensing spout outwardly.

U.S. Pat. No. 4,111,331 to Summers relates to a tamper-proof container closure device with a closed cap member that is internally threaded and has a flared annular skirt around its base which cap member coats with a crimping ring to prevent removal of the cap without tearing off the ring.

U.S. Pat. No. 4,723,671 to Mears relates to a bottle cap stand for supporting a bottle in an inverted position which has a collar with an aperture therein through which the contents of the bottle may be dispensed and a lid closure means for readily opening and closing the collar aperture.

None of the above patents provide a suitable closure for a tube container with an integral extended dispensing nozzle for a moisture sensitive material which will provide an air tight seal after initial use or a light-weight strong and stable stand for conveniently displaying or storing on end a tube container with an integral extended dispensing spout.

SUMMARY OF THE INVENTION

The closure of this invention is a cap which provides in combination with a tube an air-tight seal to protect the moisture sensitive contents of the tube with an integral extended dispensing nozzle and a stable base for the convenient display or storage in an upright position of the tube.

The cap of this invention comprises three frustums, the inner frustum being closed at its smaller end and having internal thread means suitable for coacting with external thread means of the tube, and a flat portion which when the tube is screwed fully into the cap, said flat portion and the shoulder at the end of the threads of the tube coact to provide an air-tight seal to protect the moisture sensitive contents of tube from contact with moisture of the atmosphere, the outer frustum being open at its larger end and its smaller end being sufficiently large enough to provide a stable base for the tube in an upright position, and the intermediate frustum having its larger end connected to the smaller end of the outer frustum and its smaller end connected to the larger end of the inner frustum.

PREFERRED EMBODIMENTS

Figure 1:
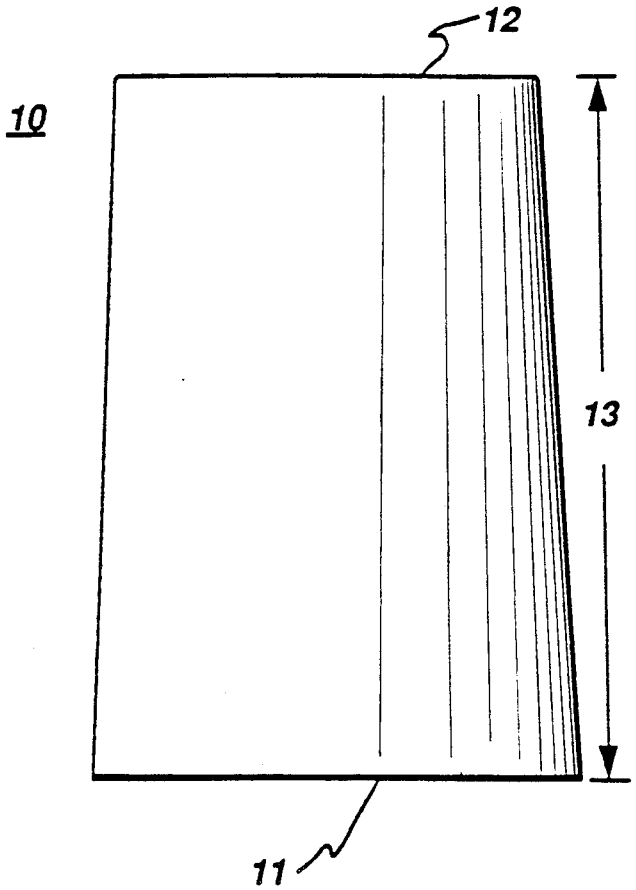
FIG. 1 is a side view of the cap.
Figure 2:
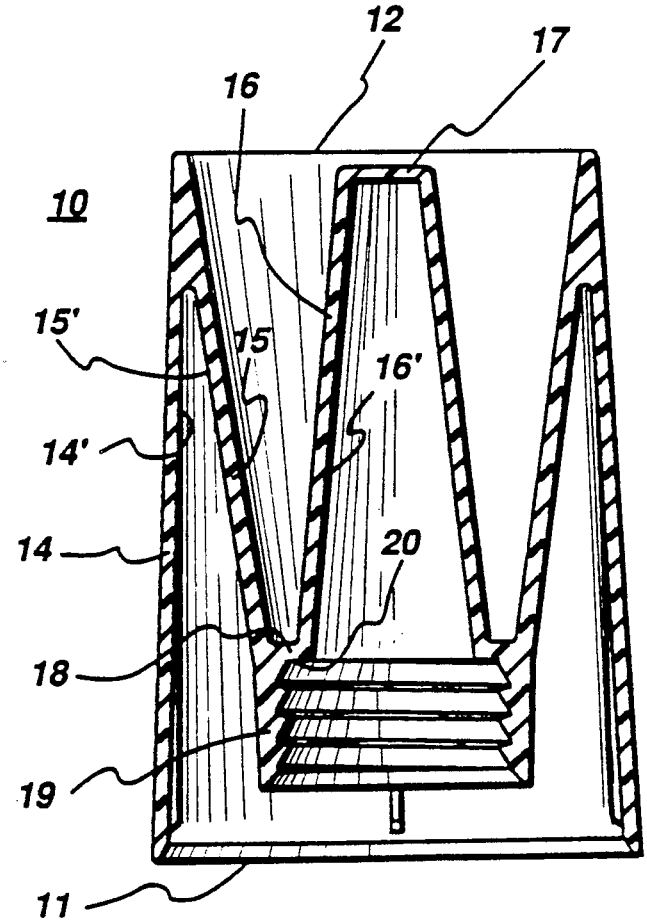
FIG. 2 is a cross-sectional view of the cap.

The cap, generally indicated by the numeral 10, has an exterior shape of a frustum. In the context of the description of this invention, the term "frustum" refers to a hollow member with the shape defined by the exterior surface of the solid geometric figure usually referred to as a frustum. The frustum may be a conic frustum, as in FIG. 3, a pyramidal frustum, as in FIG. 5, or a frustum of a cone-like shape with an oval base, as in FIG. 6. Preferably the cap has an exterior shape of a conic or pyramidal frustum. The cap may be of any suitable plastic, metal or other material having suitable strength and physical properties to have its flat portion form an air-tight seal with the end of the tube (which tube is not shown in the drawings) on which it is to be applied, sufficient rigidity for it to maintain its shape in normal usage and suitable formability so that it can be readily shaped into its configuration as shown in the drawings. A preferred material for the cap is a polyolefin plastic. A more preferred material, because of its translucency and physical properties, is polypropylene. The most preferred material is a polypropylene material containing a clarifying additive to enhance its translucency. The cap 10 has a larger end 11, which, when the cap is placed on the tube, is closest to the tube and when the cap is fully secured to the tube preferably is in contact with the seal shoulder at the end of the threads of the tube. The cap 10 also has a smaller end 12, which, when the cap is placed on the tube, is away from the tube and forms a stable platform for the tube in an upright position. The smaller dimension across the end of the cap is preferably at least 50% of the length 13 of the cap and more preferably the diameter of the end of the cap is at least 60% of the length of the cap. The exterior of the cap may have a smooth, mottled, striated or roughened surface.

The cap 10 is composed of three frustums, an inner frustum 16, an intermediate frustum 15 and an outer frustum 14. At the smaller end of the cap, the inner frustum has a closed end 17 and at the end of the inner frustum closer to the larger end 11 of the cap is a flat portion 18 connecting the inner frustum 16 to the intermediate frustum 15. An extension of the intermediate frustum 15 extending toward the larger end 11 of the cap is an interior threaded portion 19. The interior threaded portion engages the exterior threaded portion of the tube (not shown) so that when the cap is screwed tightly on to the tube the contacting flat surface 20 of the flat portion 18 adjacent the threaded portion 19 forms an air-tight seal with the contacting flat surface at the end of the exterior threaded portion of the tube (not shown). Said contacting surface on the tube is a shoulder perpendicular to the axis of the cylinder described by the threads of the tube and located between the end of the threads and the base of the extended dispensing nozzle. The interior dimensions of the inner frustum 16 are not critical so long as the dimensions are sufficient to afford space for the extending dispensing nozzle of the tube to be encased within the inner frustum 16 and closed end 17 without contact between the inner wall 16' or the closed end 17 when the cap is tightly screwed onto the tube and the contacting flat surface 20 forms an air-tight seal with the tube. The length 13 of the cap must be sufficient that, when the inner frustum 16 and enclosed end 17 are large enough to encase the extended dispensing nozzle of the tube, the enclosed end 17 does not extend beyond the plane of the smaller end 12 of the cap 10.

Figure 3:
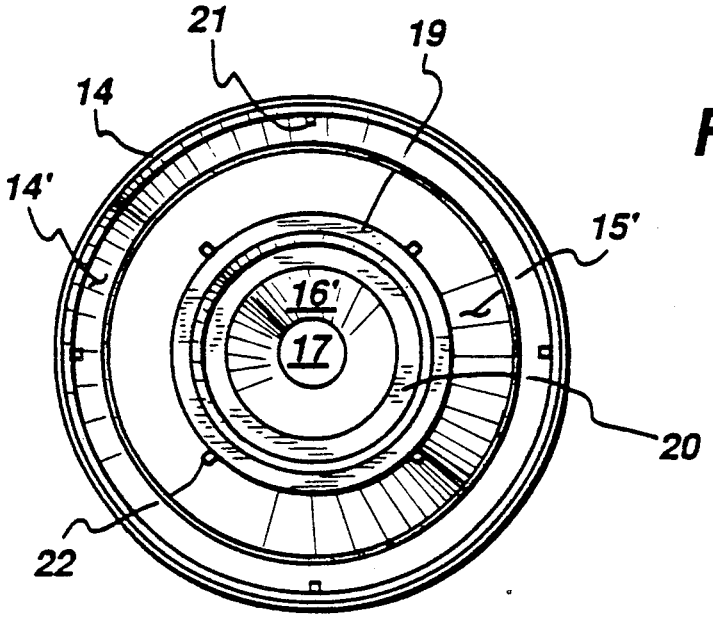
FIG. 3 is an end-view of the larger end of the cap.
Figure 4:
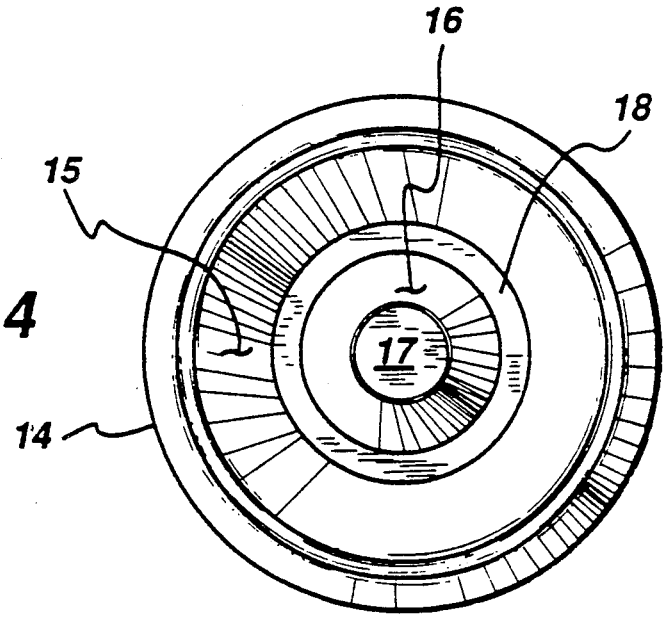
FIG. 4 is an end-view of the smaller end of the cap.

The cap 10 may optionally have reinforcing ribs 21 on the interior surface 14' of the outer frustum 14 as shown in FIG. 3 or on the exterior or the outer frustum (not shown). Likewise the cap may have reinforcing ribs 22 on the exterior surface of 15' or the intermediate frustum 15 or on the interior surface of intermediate frustum (not shown).

Figure 5:
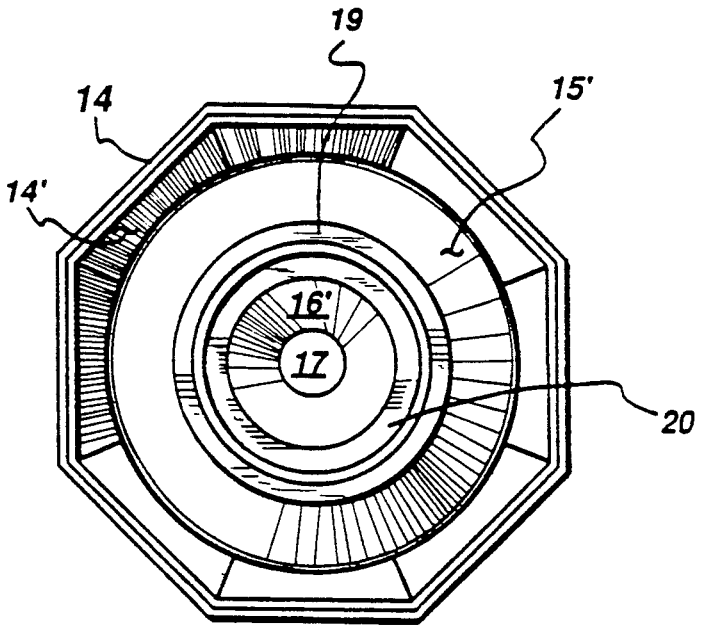
FIG. 5 is an end-view of the larger end of the cap with an exterior polygon shape.
Figure 6:
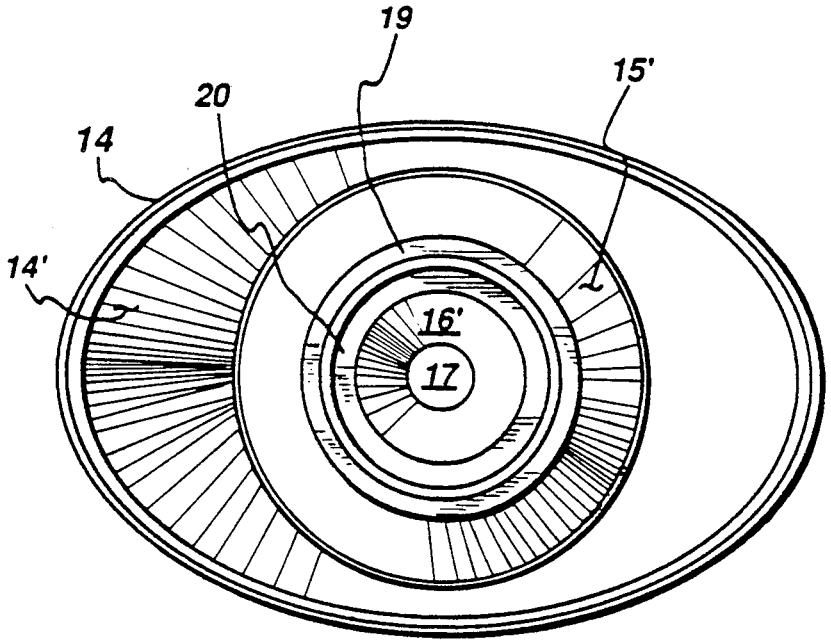
FIG. 6 is an end-view of the larger end of the cap with an exterior oval shape.

FIGS. 5 and 6 illustrate caps without reinforcing ribs.

A translucent or transparent cap is highly desirable so that when the tube is displayed for sale the prospective purchaser can see the extended dispensing nozzle of the tube and after use the user can determine without removing the cap that the end of the dispensing nozzle has been removed to dispense material from the tube.

The unique design of the cap of this invention provides an air tight seal to protect the contents of the tube from contact with air and moisture with a construction of the cap which minimizes the amount of material to manufacture the cap and provide a cap that is strong but light in weight. The three frustums reinforce each other to provide the necessary strength for the required seal but the large exterior dimensions provide easy opening and closing of the cap. Further the exterior dimensions provide a stable base for convenient display and storage of the tube when inserted into the cap. The cap is particularly useful for use on tubes of one part silicone rubber sealants and adhesives which cure to an elastomer upon exposure to atmospheric moisture. These tubes of sealants, for convenience of use, have integral dispensing nozzles which upon opening by cutting off the end of the nozzle will allow the sealant to cure into elastomer while still in the tube unless the sealant is protected by an air-tight seal from atmospheric moisture. This cap affords such necessary protection with minimum material usage while providing a convenient storage stand.

While in accordance with the Patent Statutes, a best mode and preferred embodiments have been presented, the scope of the patent protection sought is not limited thereto, but rather by the scope of the attached claims.

We claim:

1. A cap for threadable engagement with a tube which has an extended dispensing nozzle for application of a moisture-sensitive material contained in the tube comprising an outer frustum with a larger end and a smaller end suitable for providing a base for upright storage of the tube, an intermediate frustum with larger and smaller ends within said outer frustum and connected with said smaller end of the outer frustum through the larger end of the intermediate frustum, an inner frustum with a larger end and a closed smaller end within said intermediate frustum and connected with the smaller end of said intermediate frustum through the larger end of the inner frustum in a manner to provide an interior threaded portion of the cap with the interior edge of the threads describing a cylinder whose axis coincides with the axis of the three frustums comprising the cap and perpendicular to said axis a flat surface contacting portion situated such as to form an air-tight seal with a flat shoulder portion of the tube outwardly and from the extended dispensing nozzle of the tube at the end of the tube's exterior threaded portion when the tube is fully screwed into the cap, said seal sufficient to protect the moisture sensitive contents of the tube from contact with atmospheric moisture, said inner frustum and closed end sized (1) to accomodate the extended dispensing nozzle when the tube is fully screwed into the cap but (2) not to extend beyond the smaller end of the outer frustum.

2. The cap of claim 1 wherein the exterior surface of the outer frustum is conical.

3. The cap of claim 1 wherein the exterior surface of the outer frustum is polygonal.

4. The cap of claim 1 wherein the diameter of the smaller end of the outer frustum is at least 50% of the length of the cap.

5. The cap of claim 1 wherein the cap is made from a polyolefin.

6. The cap of claim 5 wherein the polyolefin is polypropylene.

7. The cap of claim 6 wherein the polypropylene is translucent.

* * * * *